US006531092B2

(12) United States Patent
Sagstad et al.

(10) Patent No.: US 6,531,092 B2
(45) Date of Patent: Mar. 11, 2003

(54) MASTER ALLOY FOR MODIFICATION AND GRAIN REFINING OF HYPOEUTECTIC AND EUTECTIC AL-SI FOUNDRY ALLOYS

(75) Inventors: Trond Sagstad, Høyanger (NO); Eivind Bondhus, Rjukan (NO)

(73) Assignee: Hydelko AS, Rjukan (NO)

( * ) Notice: Subject to any disclaimer, the term of this patent is extended or adjusted under 35 U.S.C. 154(b) by 0 days.

(21) Appl. No.: 09/794,135

(22) Filed: Feb. 28, 2001

(65) Prior Publication Data

US 2001/0031219 A1 Oct. 18, 2001

(30) Foreign Application Priority Data

Feb. 28, 2000 (NO) ..... 000987

(51) Int. Cl.[7] ..... C22C 21/00
(52) U.S. Cl. ..... 420/552; 420/528; 164/55.1
(58) Field of Search ..... 420/552, 528; 148/437; 164/55.1

(56) References Cited

U.S. PATENT DOCUMENTS 4,576,791 A * 3/1986 Thistlethwaite ..... 420/552
5,045,110 A * 9/1991 Vader et al. ..... 75/338

* cited by examiner

*Primary Examiner*—George Wyszomierski
*Assistant Examiner*—Janelle Combs Morillo
(74) *Attorney, Agent, or Firm*—Wenderoth, Lind & Ponack, L.L.P.

(57) ABSTRACT

A master alloy for modification and grain refining of hypoeutectic and eutectic Al—Si based foundry alloys is described. In addition to unavoidable contaminants the alloy contains nucleating and modifying additions of Ti, B and Sr, wherein the content of Ti is between 0.5 and 2.0% by weight, the content of B is between 0.5 and 2.0% by weight and the content of Sr is between 3.0 and 12.0% by weight, with the ratio Ti/B between 0.8 and 1.4. A method for the preparation of said master alloy is also described.

2 Claims, 2 Drawing Sheets

Micro structure in A356 after separate addition of Ti-B master alloy and Sr master alloy Magnification 65X Micro structure for an alloy according to the invention Magnification 85X Micro structure in A356 after addition of the alloy according to the invention Magnification 65X Micro structure in A356 after separate addition of Ti-B master alloy and Sr master alloy
Magnification 65X Micro structure in A356 without any addition
Magnification 65X

MASTER ALLOY FOR MODIFICATION AND GRAIN REFINING OF HYPOEUTECTIC AND EUTECTIC AL-SI FOUNDRY ALLOYS

The present application concerns a master alloy for modification and grain refining of hypoeutectic and eutectic Al—Si based foundry alloys.

During todays production of aluminium-silicon foundry alloys, additives are used to modify and grain refine the casting structure. Small grains are desirable to among others obtain better castability and smaller pores, as well as better homogeneity and mechanical properties. A modified structure implies a finely divided silicon phase which gives a significant increase in ductility and strength.

Grain refining alloys usually contain aluminium, titanium and boron in a certain ratio. An increasingly more common Al—Ti—B master alloy with a ratio 1:1 of Ti:B has been developed for foundry alloys and is described in the applicants' own Norwegian patent application 19990813, not yet published.

Modification of the cast structure takes place by introduction of strontium/sodium/antimony to the melt, often by addition of an aluminium-strontium master alloy.

Common practice is to add modifying and grain refining elements and/or master alloys of these separately. With the present invention a novel alloy has been developed which combines Al—Ti—B and strontium in one and the same product. The invention is characterized by that the content of Ti is between 0.5 and 2.0% by weight, the content of B is between 0.5 and 2.0% by weight and the content of Sr is between 3.0 and 12.0% by weight, and the ratio Ti/B is between 0.8 and 1.4.

With the alloy according to the present application a solution has been found to make it possible to simplify the addition practise in the foundries by achievement of modification and grain refining by addition of one and the same alloy. Trials show that modification and grain refining properties are at least equal to those achieved by separate addition of TiB alloy and Sr.

The invention will be described in detail in the following by way of example and with reference to the attached drawings where:

The main elements in the alloy according to the present invention are Al, Sr, Ti and B, with a composition within the following limits:

| | |
|---|---|
| Sr | 3,0 - 12,0% by weight |
| Ti | 0.5 - 2,0% by weight |
| B | 0.5 - 2,0% by weight |
| Al | rest, included possible smaller amounts of impurities |

Figure 1:
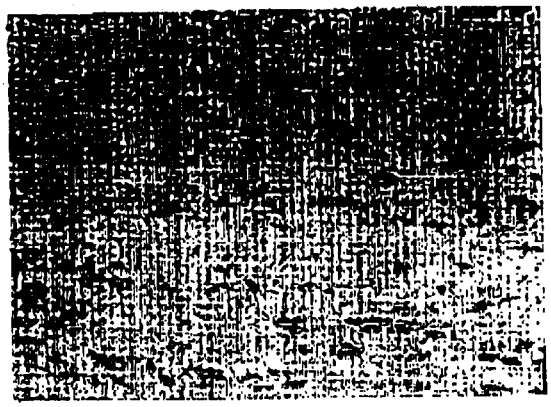
FIG. 1 shows an example of a microstructure for an alloy according to the invention.

In FIG. 1 an example of the microstructure in an alloy according to the invention is shown. The existing phases mainly consist of Al—Sr ($Al_4Sr$, eutectic), Al—Ti—B ($(Al—Ti)B_2$) and a smaller part of Sr—B ($SrB_6$). $Al_4Sr$ is present as big grey particles in the picture (size range<150 pm). $(Al,Ti)B_2$ can be seen as clouds of small light grey particles (<1 pm), whereas the Sr—B phases are small and dark grey/black (5–10 $\mu$m).

$Al_4Sr$ and eutectic will be dissolved after introduction into the melt and give a modifying effect, whereas $(Al,Ti)B_2$ particles act as nucleants for $\alpha$-Al during the seed formation.

Figure 2:
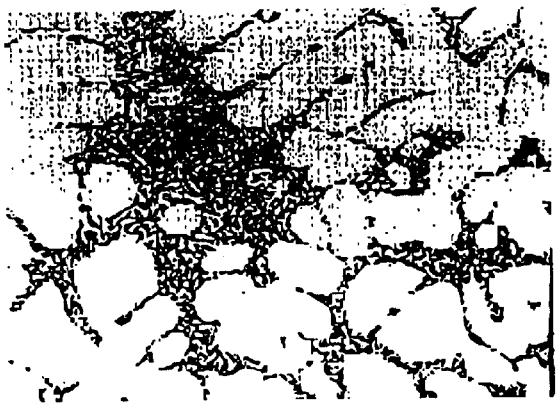
FIG. 2 shows the microstructure for an Al—Si alloy where modification and grain refining has been carried out by means of a master alloy according to the invention.
Figure 3:
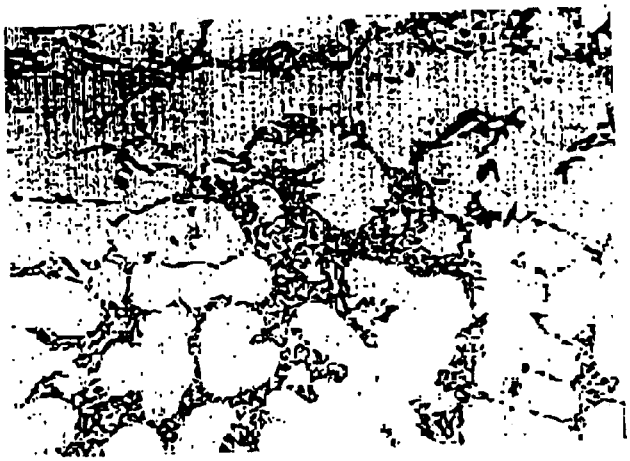
FIG. 3 shows the same Al—Si alloy where modification and grain refining has been made by means of a traditional TiB master alloy and with a subsequent addition of Sr.
Figure 4:
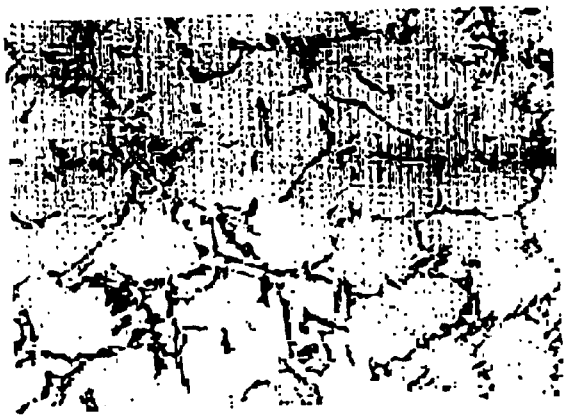
FIG. 4 shows the same Si—Al alloy without addition of modification or grain refining alloy.

FIGS. 2–4 show the casting structure with an alloy according to the invention, an alloy to which has been added conventional type TiB/AlSr, as well as without any addition, respectively. The light areas are $\alpha$-aluminium, which have been grain refined by $(Al,Ti)B_2$. FIGS. 2 and 3 show corresponding grain size. FIG. 4 has no addition of grain refiner, and has a coarser grain structure. The dark phase is the eutectic phase (Al—Si), which has been modified in an at least equal degree in FIG. 2 as in FIG. 3. FIG. 4 shows an unmodified eutectic phase (no strontium added).

The master alloy according to the invention is produced by reacting liquid aluminium with a pre-mix of the salts $KBF_4$ and $K_2TiF_6$, usually with Ti/B=0.8–1.2, or other sources of Ti and B in an equal proportion of mixture. The salts are added to liquid aluminium during stirring at a temperature of 660° C.<T>760° C. in a reaction furnace. The salts are added in powder form at a certain rate V>10 kg/min. During a time adapted to the total amount of salt. During this feeding the metal is moved by e.g. electromagnetic stirring. The salt residue ($KAlF_4$) is removed after equilibrium has been reached and melt treatment carried out, the salt is removed by pouring/decanting Strontium is then added to the alloy at a suitable temperature T=780–900° C., before the alloy is cast out as a rod, bar, waffle, billet or other forms.

EXAMPLE

Liquid aluminium, 700° C., was added to a pre-mixture of the salts $KBF_4$ (168 kg) and $K_2TiF_6$ (99 kg) in two reaction furnaces. After the end of the exothermic reaction, the salt residue was removed and the metal transferred to a holding furnace The total amount of melt was 1920 kg. Into the holding furnace it was added 195 kg metallic strontium at a starting temperature of 800° C., and thereafter casting was carried out as a Properzi bar.

The cast alloy had the following composition:

| | |
|---|---|
| Ti: | 1.5% by weight |
| B: | 1.1% by weight |
| Sr | 5.3% by weight |

The master alloy according to the invention can be used as means for modification and grain refining of all hypoeutectic and eutectic Al—Si based foundry alloys. It can be added to the melt of an Al—Si alloy in a recommended amount which is adapted to the alloy of the customer and requirements for modification/grain refining. To achieve the same addition of strontium as that used at the present time, as well as a certain amount of grain refiner also adapted to the process of the customer, the strontium level in the combination alloy has to be adapted to each customer in the Interval 3.0–12% by weight of Sr. Trials with a lower level of Sr compared to the established level and practice has been carried out with the alloy according to the invention and show good results with regard to the modification effect. In many cases the customer has a potential to reduce his use of strontium. The level of titanium in the melt should be min. 0.08% before addition of the alloy according to the invention.

Trial 1

By this trial it was an object to achieve the same modification and grain refinement by use of the master alloy according to the invention as by use of separate addition of grain refining Ti/B alloy and modifying agent.

Alloy: A356

A master alloy according to the invention with the following chemical composition was used:

| | |
|---|---|
| Sr: | 5.3% by weight |
| Ti: | 1.5% by weight |
| B: | 1.1% by weight |

The level of titanium in the Al—Si alloy to be added to the master alloy was 0.08% by weight, and the amount of master alloy added was 2.5 g/kg. This corresponds to approximately 130 ppm Sr. For traditional addition 2.5 kg/MT Ti1.6/B1.4 alloy and 200 ppm Sr are added, respectively.

| | Grain refiner index | | Modification index | |
|---|---|---|---|---|
| Sampling | Addition of master alloy according to the invention | Addition of traditional TiB alloy/AlSr | Addition of master alloy according to the invention | Addition of traditional TiB alloy/AlSr |
| Ref. Sample | 8,6 | 8.0 | 0 | 0 |
| After addition of Ti | 12.0 | 11.5 | 0.1 | 0.1 |
| 5 min. after grain refiner | 13.5 | 13.4 | 4.8 | 4.6 |
| 15 min. after grain refiner | 12.8 | 13.1 | 5.5 | 5.2 |
| 30 min. after grain refiner | 13.0 | 12.2 | 5.3 | 4.9 |
| 60 min. after grain refiner | 12.8 | 12.1 | 6.0 | 4.7 |
| 90 min. after grain refiner | 12.2 | 11.9 | 5.9 | 4.8 |

Comments: The grain refiner index is similar for the alloy according to the invention and separate addition of Ti1.6B1.4 alloy/Sr, but GRI for the alloy according to the invention shows better stability during the holding time. The table also shows that a somewhat higher modification index is achieved with a lower level of strontium (130 ppm for the alloy according to the invention, 200 ppm for separate addition).

Trial 2

Trials were made with the alloy A356.

The composition of the master alloy according to the invention was:

| | |
|---|---|
| Sr: | 6.49% by weight |
| Ti: | 1.49% by weight |
| B: | 1.20% by weight |

Three different addition levels of the inventive alloy were tested: 0.8–1.5–2.3 kg/MT. This corresponds to 50–100–150 ppm added strontium.

As comparison, results from trials with separate addition of TiB alloy (2.5 kg/MT/AlSr (200 ppm) are shown.

0.10% by weight of titanium was added to the Al—Si alloy 15 minutes before addition of the master alloy according to the invention, respective addition of the traditional TiB alloy.

Results:

Modification properties:

| | Modification index | | | |
|---|---|---|---|---|
| | Master alloy according to the invention | | | Separate addition of TiB/AlSr |
| Sampling | 0.8 [kg/MT] | 1.5 [kg/MT] | 2.3 [kg/MT] | 2.5 [kg/MT] |
| Ref. Sample | 0.2 | 0 | 0.1 | 0.1 |
| After addition of Ti | 0.4 | 0.1 | 0.2 | 4.6 |
| 5 min. after grain refiner | 4.2 | 4.5 | 3.5 | 5.2 |
| 30 min. after grain refiner | 5.3 | 7.8 | 4.9 | 4.9 |
| 60 min. after grain refiner | 5.7 | 5.6 | 6.2 | 4.7 |
| 90 min. after grain refiner | 6.0 | 6.4 | 5.6 | 4.8 |
| 120 min after grain refiner | 5.8 | 6.5 | 5.9 | 5.5 |

Grain refiner properties:

| | Grain size [mm] | | | |
|---|---|---|---|---|
| | Master alloy according to the invention | | | Separate addition of TiB/AlSr |
| Sampling | 0.8 [kg/MT] | 1.5 [kg/MT] | 2.3 [kg/MT] | 2.5 [kg/MT] |
| Ref. Sample after Ti addition | 814 | 826 | 837 | 682 |
| 5 min. after grain refiner | 550 | 401 | 380 | 400 |
| 30 min. after grain refiner | 425 | 455 | 375 | 393 |
| 60 min. after grain refiner | 545 | 453 | 357 | 388 |
| 90 min. after grain refiner | 412 | 423 | 343 | 404 |
| 120 min after grain refiner | 607 | 454 | 422 | 421 |

Comments: The trials with the alloy according to the invention show at least as good modification properties as separate addition of TiB alloy/AlSr. The grain refining efficiency is highest at 2.3 kg/MT addition of the alloy according to the invention.

What is claimed is:

1. Master alloy for modification and grain refining of hypoeutectic and eutectic Al—Si based foundry alloys, containing, in addition to unavoidable contaminants, nucleating and modifying additions of Ti, B and Sr, wherein the content of Ti is between 0.5 and 2.0% by weight, the content of B is between 0.5 and 2.0% by weight, the content of Sr is between 3.0 and 12.0% by weight, and the ratio Ti/B is between 0.8 and 1.4 by weight.

2. Method for making a master alloy according to claim 1, which comprises making said alloy by pre-mixing salts $KBF_4$ and $K_2TiF_6$, adding said premixed salts to liquid aluminium during stirring at a temperature between 660° C. and 760° C. in a reaction furnace, whereby the salt residue ($KAlF_4$) is removed after equilibrium has been reached, and adding Sr to the alloy at a temperature between 780 and 900° C., before casting of the alloy.

* * * * *